US010413902B2

(12) United States Patent
Bru Gilbert et al.

(10) Patent No.: US 10,413,902 B2
(45) Date of Patent: Sep. 17, 2019

(54) APPARATUS FOR SAMPLE SEPARATION AND COLLECTION

(71) Applicant: STAT-DIAGNOSTICA & INNOVATION, S.L., Barcelona (ES)

(72) Inventors: Rafael Bru Gilbert, Barcelona (ES); Mathias Kuphal, Barcelona (ES); Jordi Carrera Fabra, Barcelona (ES); Ricard Martin Blanco, Barcelona (ES); Francisco Javier Ramírez, Barcelona (ES)

(73) Assignee: STAT-DIAGNOSTICA & INNOVATION, S.L. (ES)

( * ) Notice: Subject to any disclaimer, the term of this patent is extended or adjusted under 35 U.S.C. 154(b) by 412 days.

(21) Appl. No.: 15/210,689

(22) Filed: Jul. 14, 2016

(65) Prior Publication Data

US 2017/0014823 A1 Jan. 19, 2017

Related U.S. Application Data

(60) Provisional application No. 62/193,954, filed on Jul. 17, 2015.

(51) Int. Cl.
*B01L 3/00* (2006.01)
*B04B 15/08* (2006.01)
(Continued)

(52) U.S. Cl.
CPC ..... *B01L 3/502753* (2013.01); *B04B 5/04* (2013.01); *B04B 7/02* (2013.01);
(Continued)

(58) Field of Classification Search
CPC ..... B01L 3/502715; B01L 3/502753; B01L 2200/027; B01L 2200/0684;
(Continued)

(56) References Cited

U.S. PATENT DOCUMENTS 2,885,145 A 5/1959 Danielsson et al.
2008/0023380 A1 1/2008 Oki et al.
(Continued)

FOREIGN PATENT DOCUMENTS

WO WO 91/18656 A1 12/1991
WO WO 94/00169 A1 1/1994

OTHER PUBLICATIONS

International Search Report and Written Opinion directed to related International Patent Application No. PCT/IB/2016/054244, dated Oct. 17, 2016; 13 pages.

*Primary Examiner* — Timothy C Cleveland
(74) *Attorney, Agent, or Firm* — Sterne, Kessler, Goldstein & Fox P.L.L.C.

(57) ABSTRACT

A centrifuge device and method for use are presented. The centrifuge device includes a housing, a chamber, a channel, and a cover. The housing includes a first port and a vent opening and is designed to rotate about an axis passing through a center of the housing. The chamber is defined within the housing and is coupled to the first port. A first portion of the chamber has a width that tapers between a first width at a first position and a second width at a second position within the chamber, the first width being greater than the second width. The channel is coupled to the second position of the chamber and arranged such that a path exists for gas to travel from the channel to the vent opening. The cover provides a wall that seals the chamber.

16 Claims, 9 Drawing Sheets

(51) Int. Cl.

| | |
|---|---|
| ***B04B 7/02*** | (2006.01) |
| ***B04B 7/06*** | (2006.01) |
| ***B04B 5/04*** | (2006.01) |
| ***B04B 7/08*** | (2006.01) |

(52) U.S. Cl.
CPC ..... *B04B 7/06* (2013.01); *B04B 7/08* (2013.01); *B04B 15/08* (2013.01); *B01L 3/502715* (2013.01); *B01L 2200/027* (2013.01); *B01L 2200/0684* (2013.01); *B01L 2300/0803* (2013.01); *B01L 2300/0864* (2013.01); *B01L 2400/0409* (2013.01); *B04B 2007/025* (2013.01)

(58) Field of Classification Search
CPC ..... B01L 2300/0803; B01L 2300/0864; B01L 2400/0409; B04B 5/04; B04B 7/02; B04B 7/06; B04B 7/08; B04B 15/08; B04B 2007/025
See application file for complete search history.

(56) References Cited

U.S. PATENT DOCUMENTS

| | | | |
|---|---|---|---|
| 2013/0244241 A1 | 9/2013 | Carrera Fabra et al. | |
| 2017/0095812 A1* | 4/2017 | Boehm | B01L 3/5027 |

* cited by examiner

APPARATUS FOR SAMPLE SEPARATION AND COLLECTION

CROSS REFERENCE TO RELATED APPLICATIONS

This application claims the benefit of U.S. provisional application No. 62/193,954 filed on Jul. 17, 2015, the disclosure of which is incorporated by reference herein in its entirety.

BACKGROUND

Field

Embodiments of the present invention relate to the field of clinical diagnostic tools.

Background

Whole blood is widely used in in-vitro diagnostic research. Blood tests can provide valuable information for clinical diagnosis and drug development. However, most blood is analyzed using the blood plasma or serum, because red blood cells and their constituent substances (blood cell containing components) can interfere with the measurement. Thus, separation of serum or plasma from whole blood is a typical preparation step for blood analysis.

Conventionally, serum or plasma separation is performed by centrifugation using commercially available bench-top devices. This process is laborious and time-consuming, and the integration of centrifugal systems in small point-of-care devices is challenging and size-limited. Hence, other separation techniques are under development which allow for integration into point-of-care devices. Such techniques are based on the principles of electro-osmotic flow, hydrodynamic separations, acoustic forces, dielectrophoresis and particle retention. The latter separation principle normally relies on asymmetric membranes, which block red blood cells from passing such a filter. Plasma filtration is a promising plasma separation method, but has many drawbacks or challenges to overcome. Drawbacks are related to filter/membrane integration, clogging, plasma re-collection from the membrane and undesirable filtering of biomolecules. Further, filtration is time consuming and blood with a high hematocrit has to be diluted.

Electro-osmotic flow and hydrodynamic separations principles are used for microfluidic devices with analyte volumes in the micro-liter range. However, such techniques exhibit less plasma separation efficiency than centrifugation-based techniques.

BRIEF SUMMARY

A method, apparatus, and system for sample separation via centrifugation are presented. The integration of centrifugation-based plasma separation in in-vitro diagnostic devices is challenging due to size limitations, integration issues and low cost fabrication. The centrifuge device presented herein allows for efficient separation of plasma from whole blood using small sample volumes. For example, sample volumes of less than 500 microliters can be used. In other examples, sample volumes between 500 microliters and 1000 microliters, or between 1000 microliters and 5000 microliters, can be used.

In an embodiment, a centrifuge device includes a housing, a chamber, a channel, and a cover. The housing includes a first port and a vent opening and is designed to rotate about an axis passing through a center of the housing. The chamber is defined within the housing and is coupled to the first port.

A first portion of the chamber has a width that tapers between a first width at a first position and a second width at a second position within the chamber, the first width being greater than the second width. The channel is coupled to the second position of the chamber and arranged such that a path exists for gas to travel from the channel to the vent opening. The cover provides a wall that seals the chamber.

An example method is described. The method includes placing a sample into a centrifuge chamber via a first port, the centrifuge chamber being defined within a cylindrical housing. Next, the first port is sealed to prevent any leakage of the sample back through the inlet. The centrifuge chamber is rotated about an axis passing through a center of the cylindrical housing. The rotation causes a separation of the sample within the chamber, where a first portion of the sample moves into a first portion of the chamber that extends along a circumference of the cylindrical housing and a second portion of the sample moves into a second portion of the chamber that extends radially from the axis passing through the center of the cylindrical housing. The method continues with stopping the rotation of the centrifuge chamber and extracting the second portion of the sample via a second port.

In another embodiment, a system includes a centrifuge device, an actuator, and an extraction device. The centrifuge device includes a housing, a chamber, a channel, and a cover. The housing includes a first port and a vent opening, and is designed to rotate about an axis passing through a center of the housing. The chamber is defined within the housing and is coupled to the first port. A first portion of the chamber has a width that tapers between a first width at a first position and a second width at a second position within the chamber, the first width being greater than the second width. The channel is coupled to the second position of the chamber and arranged such that a path exists for gas to travel from the channel to the vent opening. The cover has a second port and provides a wall that seals the chamber. The actuator is coupled to the housing and rotates the housing about the axis. The extraction device is coupled to the cover and extracts a sample within the chamber through the second port.

BRIEF DESCRIPTION OF THE DRAWINGS/FIGURES

The accompanying drawings, which are incorporated herein and form a part of the specification, illustrate embodiments of the present invention and, together with the description, further serve to explain the principles of the invention and to enable a person skilled in the pertinent art to make and use the invention.

FIG. 1 illustrates a test cartridge, according to an embodiment.

FIGS. 2A-2D provide three-dimensional illustrations of a centrifugation device, according to some embodiments.

Embodiments of the present invention will be described with reference to the accompanying drawings.

DETAILED DESCRIPTION

Although specific configurations and arrangements are discussed, it should be understood that this is done for illustrative purposes only. A person skilled in the pertinent art will recognize that other configurations and arrangements can be used without departing from the spirit and scope of the present invention. It will be apparent to a person skilled in the pertinent art that this invention can also be employed in a variety of other applications.

It is noted that references in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure or characteristic is described in connection with an embodiment, it would be within the knowledge of one skilled in the art to effect such feature, structure or characteristic in connection with other embodiments whether or not explicitly described.

Some embodiments described herein relate to a centrifuge device used to separate small sample volumes of less than 500 μL, between 500 μL and 1000 μL, or between 1000 μL and 5000 μL. The centrifuge device may be oriented along a horizontal axis such that it revolves about the horizontal axis. In some embodiments, the centrifuge device is designed to be integrated with a larger diagnostic testing system, such as a test cartridge. The test cartridge integrates all of the components necessary to perform such tests into a single, disposable package. The test cartridge may be configured to be analyzed by an external measurement system that provides data related to the reactions that take place within the test cartridge. In an embodiment, the test cartridge includes a plurality of test chambers with a transparent window to perform optical detection with each test chamber.

Figure 1:
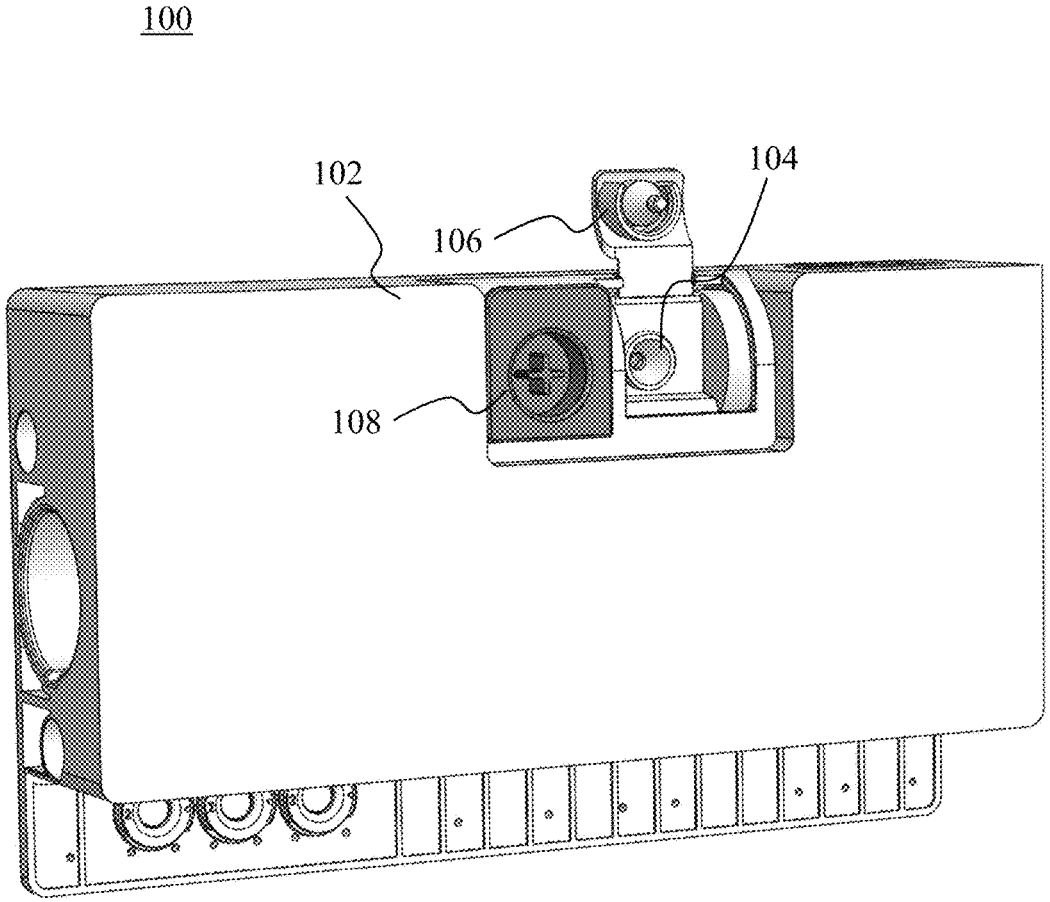

FIG. 1 illustrates an example test cartridge system 100, according to an embodiment. Test cartridge system 100 includes a cartridge housing 102, which may house a variety of fluidic chambers, channels, and reservoirs. Samples may be introduced into cartridge housing 102 via sample port 104, according to an embodiment. Sample port 104 may be an opening into a centrifugation chamber that is integrated within cartridge housing 102. For example, a blood sample may be placed into the centrifuge device via sample port 104 and the plasma may be separated out. Afterwards, the plasma may be extracted from the centrifuge device and placed into other chambers of test cartridge system 100 for further analysis and testing. A cap 106 may be used to seal sample port 104 after the sample has been placed into sample port 104. Although cap 106 is illustrated as being connected to housing 102, and swinging downwards to seal sample port 104, this is just an example, and any cap design can be used as would be understood by a person skilled in the art.

In an example, sample port 104 receives liquid samples, though other sample types may be used as well. Sample port 104 may also be designed to receive a needle of a syringe in order to inject a sample into a chamber or fluidic channel within cartridge housing 102. Sample port 104 may also be designed to be compatible with commercial blood collection devices, such as those of the VACUTAINER™ family.

Test cartridge 100 also includes another sample inlet protected by a cover 108. Cover 108 is removable to allow access to the additional sample inlet. This sample inlet may be used to introduce samples that do not need to be centrifuged.

The description herein will focus more on the design and function of the centrifuge device. Further details about test cartridge system 100 may be found in co-pending U.S. application Ser. No. 13/836,845, the disclose of which is incorporated by reference herein in its entirety.

Figure 2A:
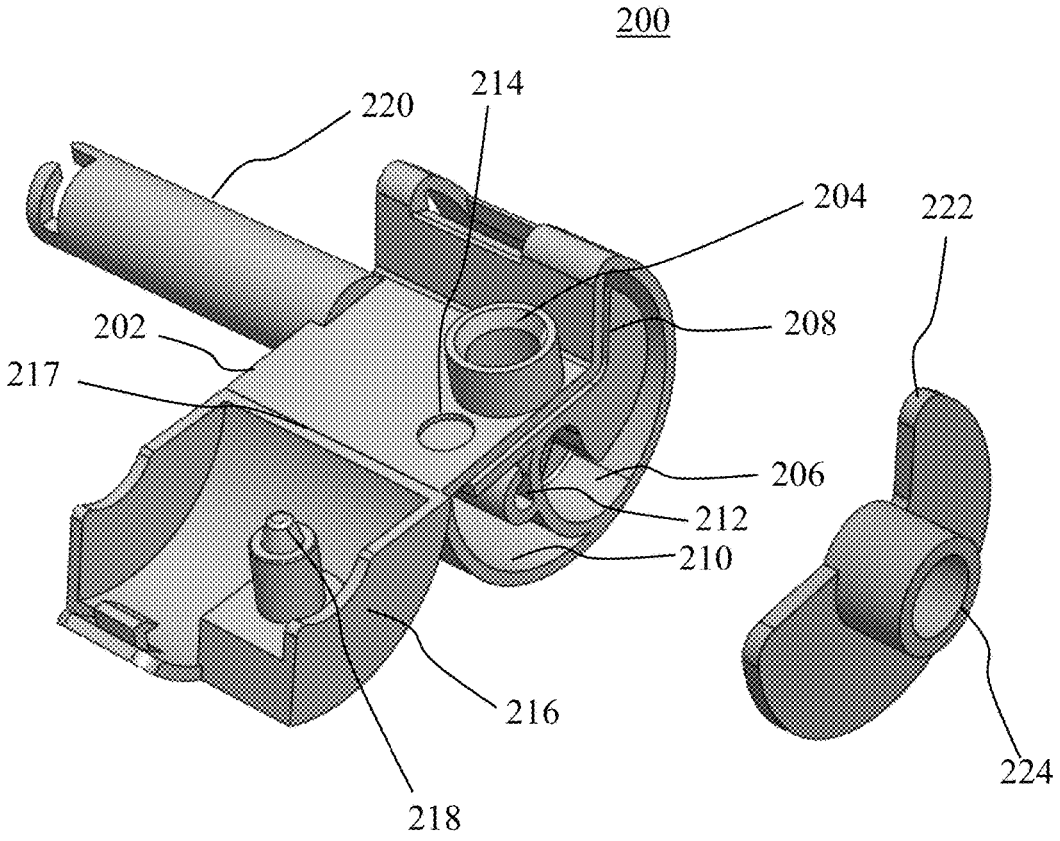

FIG. 2A illustrates a three-dimensional rendering of a centrifuge device 200, according to an embodiment. Centrifuge device 200 includes a cylindrical housing 202 coupled with a rotating arm 220, and a cover 222. While housing 202 is described herein as cylindrical, one of skill in the art would recognize that other shapes may be used that maintain the same functionality as described herein. Cylindrical housing 202 rotates about an axis passing through rotating arm 220 and substantially through the center of cylindrical housing 202. Cover 222 may be removable for access to the various chambers and channels within cylindrical housing 202, and provides a sealing wall above the various chambers and channels when attached to cylindrical housing 202. In another embodiment, cover 222 is permanently fixed to cylindrical housing 202, and may be an integral part of cylindrical housing 202.

According to an embodiment, cylindrical housing 202 includes a rotating portion 216 that rotates around a hinged connection 217. Rotating portion 216 may swing open to reveal an input port 204 for placing a sample into centrifuge device 200. The sample may be placed through inlet port 204 using a syringe or any other suitable fluid transfer mechanism. Rotating portion 216 may include a raised structure 218 that is dimensioned to fit into inlet port 204 when rotating portion 216 is shut. Raised structure 218 may seal inlet port 204 from any leakage. Raised structure 218 may include, for example, a gasket design with a polymer tip to seal the opening of inlet port 204.

Any sample placed through inlet port 204 goes into a centrifuge chamber 206. Centrifuge chamber 206 includes a curved geometry designed to aid in the separation of the sample during centrifugation as explained in more detail with reference to FIG. 3. Coupled with one end of centrifuge chamber 206 is a vent channel 208, according to an embodiment. Vent channel 208 provides an unobstructed flow for gas, such as air, from centrifuge chamber 206 to a vent opening 212. During centrifugation and subsequent extraction of the separated sample, the ability to vent gas, such as air, out through vent opening 212 may help to reduce the formation of bubbles.

In an embodiment, a collection chamber 210 is coupled between vent channel 208 and vent opening 212. Collection chamber 210 may be provided to receive the sample through vent channel 208 as the sample fills centrifuge chamber 206. The centrifugation process may not work correctly if the sample does not fill, or substantially fill, centrifuge chamber 206. Bubbles may form if there is too much trapped air within centrifuge chamber 206. Thus, collection chamber 210 may act as a safeguard to collect the sample before it can leak out of vent opening 212.

In an embodiment, cylindrical housing 202 includes a sample indicator 214 that is designed to indicate to a user when centrifuge chamber 206 is full or nearly full with a sample. For example, sample indicator 214 may turn a specific color when centrifuge chamber 206 is full. Sample indicator 214 may be made transparent or semi-transparent allowing the user to perceive when the sample has completely filled centrifuge chamber 206.

Cover 222 may be placed over one side of cylindrical housing 202 to seal one or more of the chambers defined therein. According to an embodiment, cover 222 includes a coupling structure 224 to allow for a connection to a extraction device. The base of the coupling structure 224 includes a port (not shown in this figure) for extracting out the separated sample within centrifuge chamber 206. The extraction device may be a syringe or a portion of the test cartridge described earlier with reference to FIG. 1.

Figure 2B:
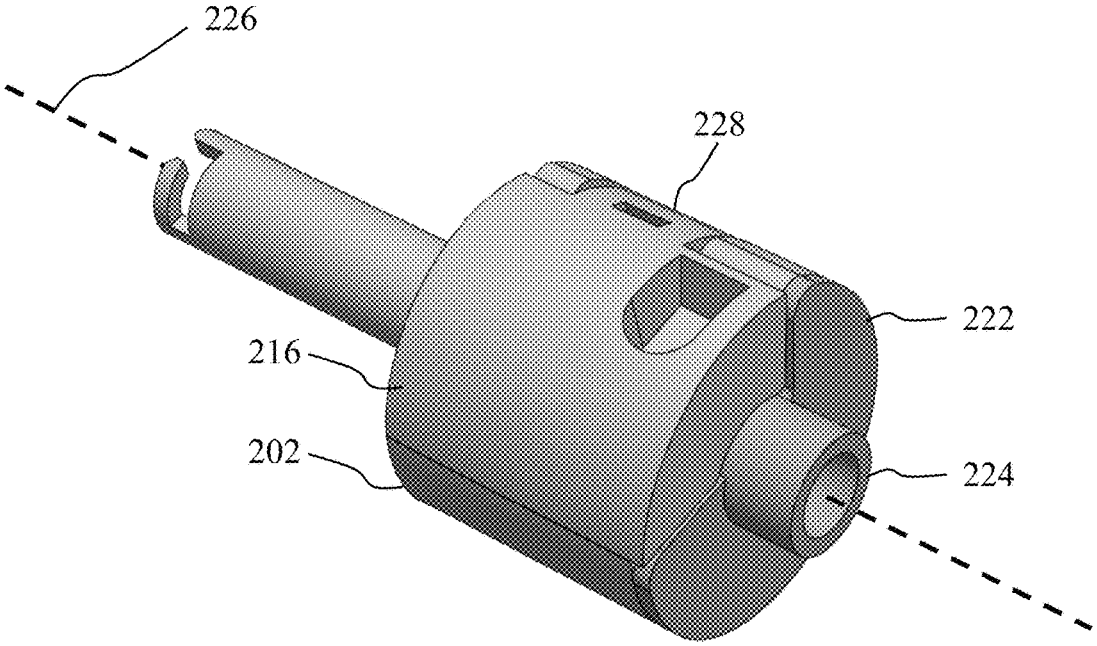

FIG. 2B illustrates centrifuge device 200 with rotating portion 216 of cylindrical housing 202 closed, according to an embodiment. Cylindrical housing 202 rotates about an axis 226 to centrifuge a sample placed within. Rotating portion 216 may use a snap mechanism 228 to maintain rotating portion 216 in place after being rotated shut. Snap mechanism 228 may include a physical mating between two structures, or may include magnets to keep rotating portion 216 shut.

Figure 2C:
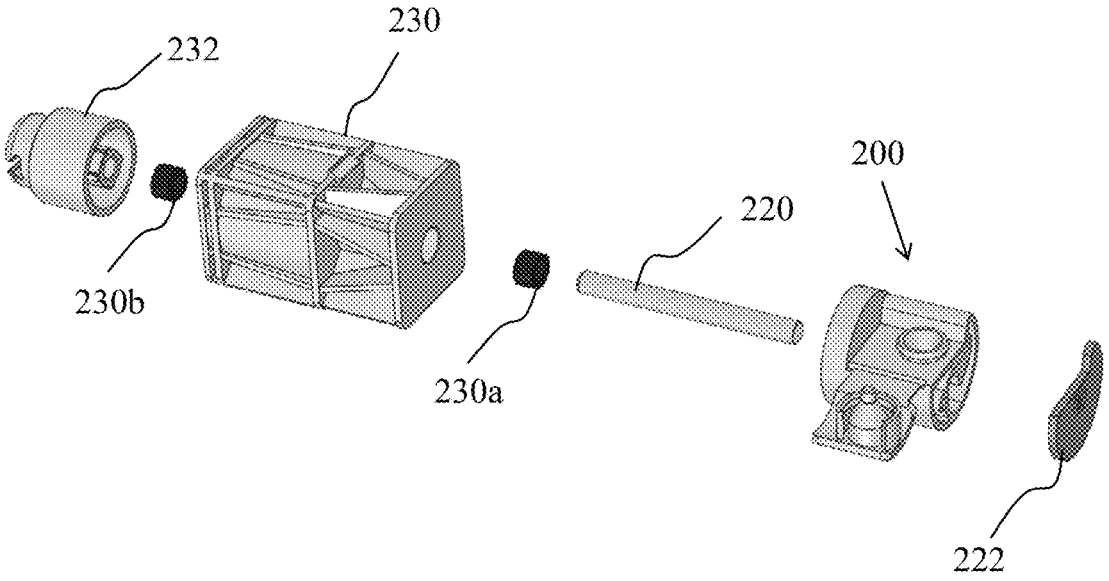

FIG. 2C illustrates an expanded view of various components that may be used with centrifuge device 200. In an embodiment, rotating arm 220 may be stabilized via bushings 230*a* and 230*b*, which in turn are connected to a structure 230. Structure 230 may be any structure that provides support and stabilization for rotating arm 220. While one end of rotating arm 220 is connected to centrifuge device 200, the other end is connected to a coupling element 232, according to an embodiment. Coupling element 232 may be used to connect directly with an actuator to drive rotating arm 220.

Figure 2D:
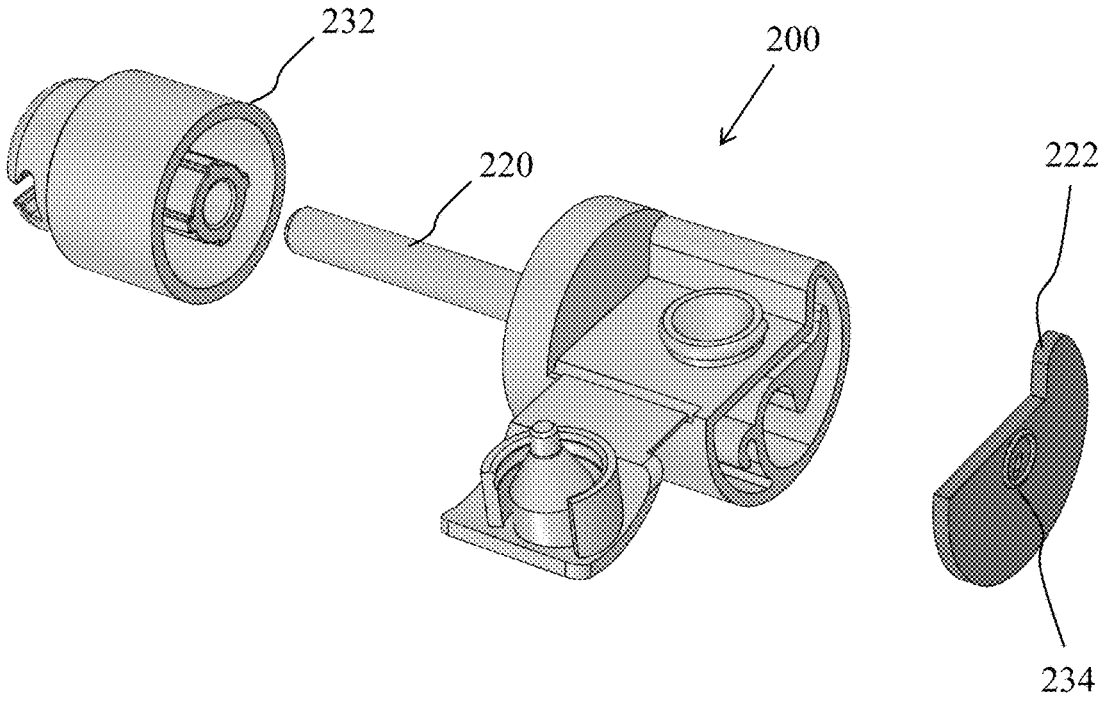

FIG. 2D provides an illustration of centrifuge device 200 according to another embodiment. Structure 230 is not shown in this figure for clarity. Cover 222 is illustrated with a different coupling structure 234. Coupling structure 234 may be a gasket ring, or any other structure used to form a fluidic seal when extracting a sample from centrifuge device 200 via a port (not shown) through cover 222. Other coupling structure designs would be well understood to a person skilled in the art.

Figure 3:
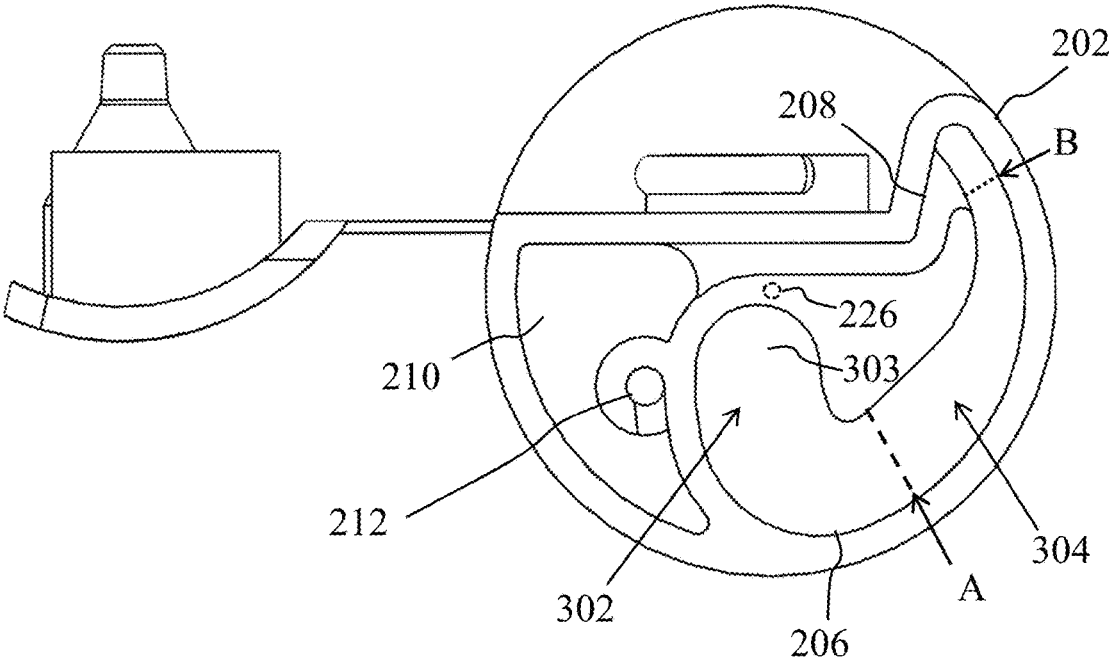
FIG. 3 illustrates a front-facing view of a centrifugation device, according to an embodiment.

FIG. 3 illustrates a front facing view of centrifuge device 200, according to an embodiment. Axis of rotation 226 is illustrated passing substantially through the center of the device. The geometry of centrifuge chamber 206 may be more easily observed in this view. According to an embodiment, centrifuge chamber 206 includes two sections: a collection area 302 oriented perpendicular to axis of rotation 226 and extending away radially; and a tail area 304 that extends around the circumference of cylindrical housing 202. Collection area 302 may include an increasing slope of wall 303 from a center area of collection area 302 towards a border wall of collection area 302 in order to aid in the accumulation of the separated sample in collection area 302. Tail area 304 curves away from collection area 302 with a decreasing width and ends by coupling with vent channel 208, according to an embodiment. The curved shape of tail area 304 may facilitate keeping the overall diameter of centrifuge device 200 as low as possible, while maximizing the volume of collection area 302 and tail area 304. In another embodiment, tail area 304 is not curved, but extends away from collection area 302 in a straight line.

During rotation of device 200, a relative centrifugal force (RCF) is taking effect. Collinear to the center of rotation, RCF is zero, and perpendicular to the rotation axis RCF is increasing by a value of:

$$RCF = \frac{r\omega^2}{g} \tag{1}$$

where g is earth's gravitational acceleration, r is the rotational radius and w is the angular velocity in radians per unit time. RCF is increasing when r is increasing and particles with a high density are accelerated with a higher force than particles with a lower density. Thus, over time during the rotation, the sample is separated into two phases: a denser phase separates into tail area 304 while a less dense phase separates into collection area 302. In the example of using a whole blood sample, the blood plasma separates into collection area 302 while the remaining blood cell and any contaminants are separated into tail area 304.

The changing width of tail area 304 is designed to aid in draining the less dense material into collection area 302 during the rotation. The width at location 'A' of tail area 304 may be larger than the width at location 'B' of tail area 304, with the width tapering between locations 'A' and 'B'. At or near location 'B' where the width has tapered to its lowest point, tail area 304 couples to vent channel 208 according to an embodiment. Vent channel is routed back towards the center of cylindrical housing 202 such that a shortest distance from the axis of rotation 226 to vent channel 208 is shorter than any point within centrifuge chamber 206 to axis of rotation 226. This design helps to ensure a stable position of the sample during centrifugation and passively works to prevent air bubbles from entering into centrifuge chamber 206 from vent opening 212.

Centrifuge chamber 206 may have a volume of less than 500 μL, less than 400 μL, or less than 300 μL. In one example, centrifuge chamber 206 holds a 250 μL sample of whole blood. After centrifugation at between 5,000 and 20,000 RPM for about 3 minutes, about 60-70 μL to about 100-150 μL, of plasma may be separated into collection area 302. Centrifugation may be performed at, for example, 10,000 RPM.

Following centrifugation, or during centrifugation after a given period of time has elapsed, the sample has separated into a less dense phase in collection area 302 and a more dense phase in tail area 304. At this point, extraction of the separate phases may be performed via an outlet port (not shown, but described herein with reference to FIGS. 4A-4C.) A hydraulic diameter of centrifuge chamber 206 may be designed such that capillary forces prevent the separated phases from mixing during extraction of each sample phase from centrifuge chamber 206. For example, an interface layer existing between the two separated phases should remain unbroken by bubbles during the extraction process. Based on the example dimensions of centrifuge chamber 206 given above, the hydraulic diameter of centrifuge chamber 206 may be less than about 5 or 6 millimeters to maintain separation of the phases during extraction.

Figure 4A:
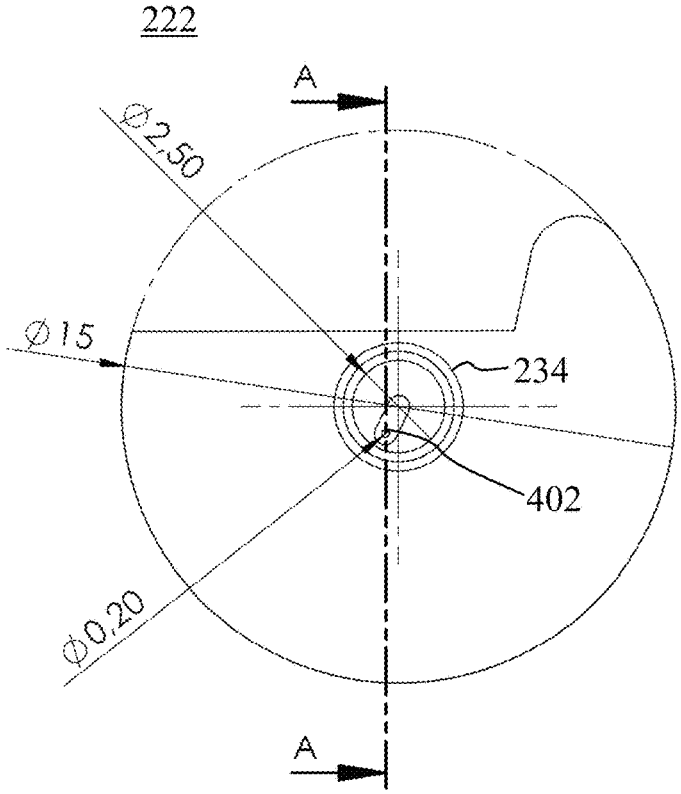
FIGS. 4A-4C illustrate views of a cover for a centrifugation device, according to some embodiments.
Figure 4B:
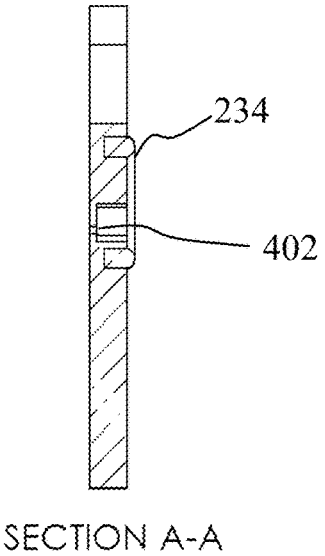

FIGS. 4A and 4B illustrate example dimensions of cover 222. FIG. 4A illustrates a front-facing view of cover 222 showing outlet port 402 through the base of coupling structure 234. Cover 222 may have a diameter of less than 20 mm, such as a diameter of 15 mm as illustrated. Similarly, cylindrical housing 202 may have substantially the same diameter as cover 222. Coupling structure 234 may have a diameter of less than 5 mm, such as a diameter of 2.5 mm as illustrated. Outlet port 402 is illustrated with a diameter of about 200 micrometers, but this diameter may be any diameter in the range from 100 to 500 micrometers. In another example, the diameter of outlet port 402 is in the range from 150 to 350 micrometers. The diameter of outlet port 402 may be any diameter that is small enough to ensure that the liquid sample cannot leak out of outlet port 402 during either introduction of the sample into centrifuge chamber 206 or during rotation of the centrifuge device. In one embodiment, an area of a cross section of outlet port 402 is less than a quarter of an area of a cross section of vent channel 208.

According to an embodiment, during the sample extraction process, the sample is drawn out of centrifuge chamber 206 through outlet port 402, and air enters into centrifuge chamber 206 through vent channel 208. During this operation, the increasing cross-section of tail area 304 helps to prevent bubbles from flowing into collection area 303 and displacing the liquid within collection area 303.

FIG. 4B illustrates a side view of cover 222 that also shows outlet port 402 extending through a thickness of cover 222. When cover 222 is placed over cylindrical housing 202, outlet port 402 is aligned over collection area 302 of centrifuge chamber 206, according to an embodiment. After the rotation has ceased, or while centrifuge device is still rotating, the separated sample in collection area 302 may be extracted out through outlet port 402. Coupling structure 234 may be used to form a leak-proof seal with another structure used to extract the sample through outlet port 402 via an applied pressure differential.

Figure 4C:
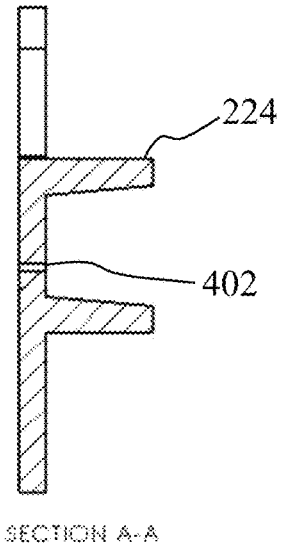

FIG. 4C illustrates a side view of cover 222, according to another embodiment that includes a different coupling structure 224. An extraction device may be physically coupled to coupling structure 224 to extract out the sample, via an applied pressure differential.

Figure 5:
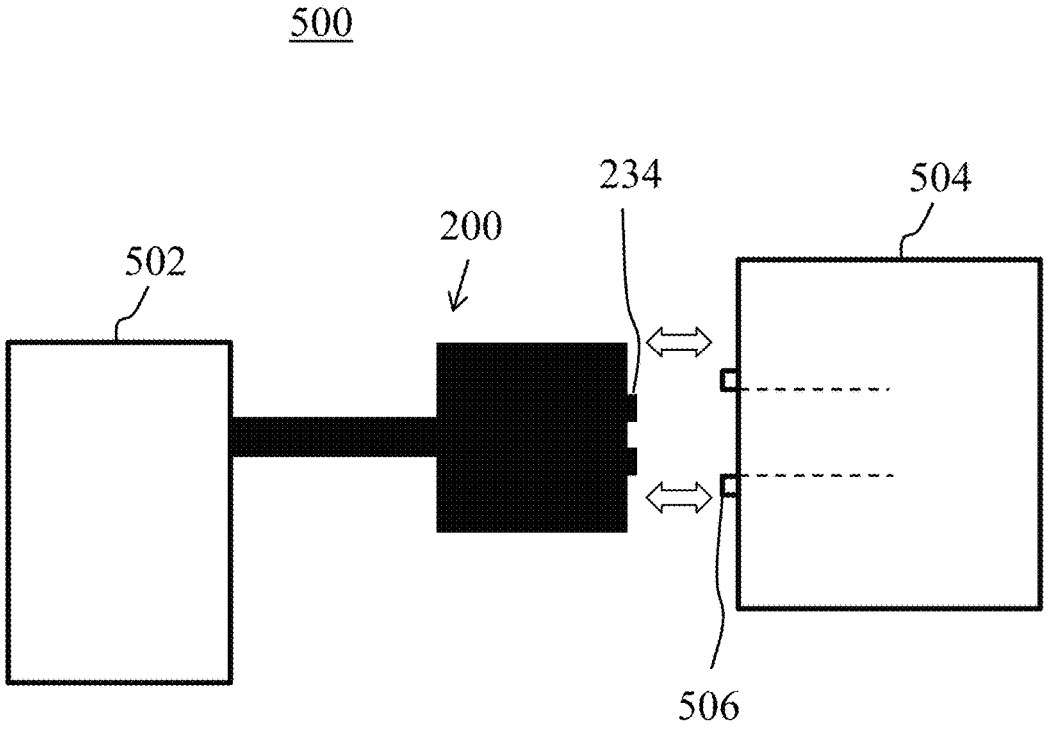
FIG. 5 illustrates a centrifugation system, according to an embodiment.

FIG. 5 illustrates an example system 500 that includes a centrifuge device 200 coupled to an actuator 502. Actuator 502 may be any type of motor (induction motor, stepper motor, etc.) that causes centrifuge device 200 to rotate at a high speed of several thousand RPM. Also illustrated in system 500 is extraction device 504. In an embodiment, extraction device 504 also includes a structure 506 used to form a substantially leak-proof seal between coupling structure 234 and extraction device 504. Note that structure 506 may be designed to couple with any type of coupling structure on centrifuge device 200. In one embodiment, extraction device 504 includes a movable transfer chamber that is part of a test cartridge system like the one described with reference to FIG. 1.

Figure 6:
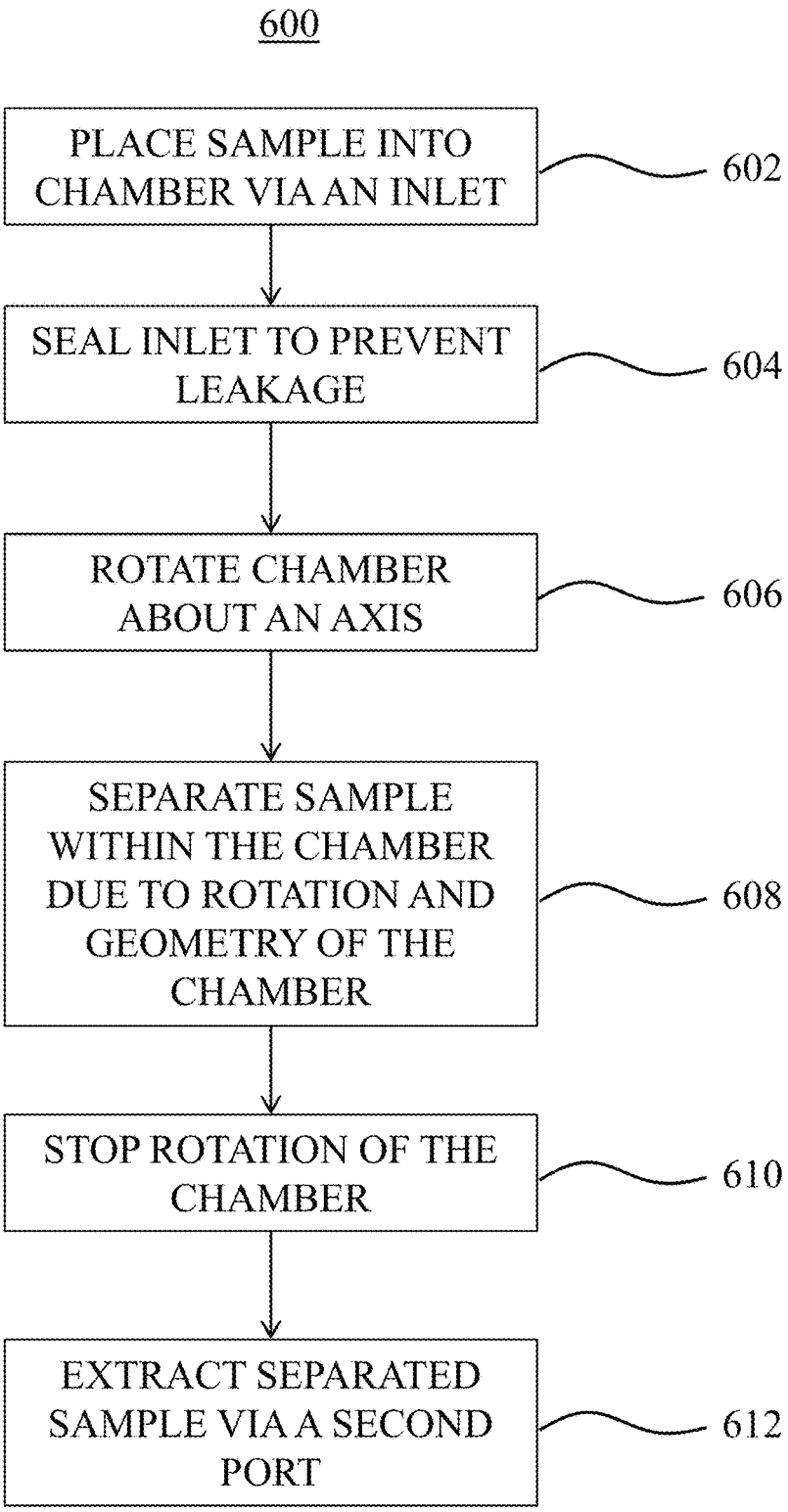
FIG. 6 illustrates an example method.

FIG. 6 is a flow chart illustrating a method 600 for using a centrifuge device to separate a sample, according to an embodiment. It should be understood that the steps shown in method 600 are not exhaustive and that other steps may be performed as well without deviating from the scope or spirit of the invention. Many of the steps of method 600 may be performed, for example, by centrifuge device 200.

At block 602, a sample is placed into a chamber via a first port (e.g., an inlet port). The sample may be a mixture of varying density components, such as a blood sample that includes red blood cells and other particles, and less dense plasma. The sample may be placed into an inlet via a syringe or another more integrated fluidic delivery system (e.g., microfluidic channels). The inlet leads into a centrifuge chamber defined within a cylindrical housing, according to an embodiment.

At block 604, the inlet is sealed to prevent leakage of the sample during centrifuging. Sealing the inlet may be performed by snapping shut another part of the centrifuge device, such that the inlet port is plugged. Any other well-known sealing mechanism may be used.

At block 606, the chamber is rotated about an axis passing through the center of the cylindrical housing to centrifuge the sample within the chamber. In one example, the chamber is rotated at a speed of about 5,000 to 20,000 RPM. In one particular example, the chamber is rotated at a speed of 10,000 RPM. The chamber may be designed such that it curls around an outer edge of the centrifuge device as illustrated, for example, in FIG. 3. This geometry aids in separating the sample based on density into different sections of the chamber.

At block 608, the sample is separated based on the centrifugal force applied within the chamber during the rotation. As noted above, the geometry of the chamber also helps to keep the denser material of the sample within a first section of the chamber, and a less dense material within a second section of the chamber. In an embodiment, the first section of the chamber extends along a circumference of the cylindrical housing while the second section of the chamber extends radially outward from the axis of rotation passing through the center of the cylindrical housing.

At block 610, the rotation of the chamber is stopped. In one example, the rotation of the chamber at 10,000 RPM stops after about 3 minutes. An abrupt stop also forces the more dense material to collect in the first section of the chamber, away from the less dense material collecting in the second section of the chamber.

At block 612, the less dense portion of the sample is extracted via a second port (e.g., an outlet port). The outlet port may be positioned substantially above the second section of the chamber, such that extracting through the outlet port only extracts the less dense material from the second section of the chamber following centrifugation. The extraction may occur due to an applied pressure differential (e.g., a vacuum pressure) applied at the outlet port. A syringe may also be used to extract the less dense material following centrifugation.

According to an embodiment, method 600 is performed without stopping the rotation of the chamber to extract the sample (i.e., skipping block 610.) The outlet port may be substantially centered over the axis of rotation.

Other steps may be performed in addition to part of method 600. For example, if the centrifuge device is integrated into a test cartridge, some steps may involve disengaging the centrifuge device from a fluidic coupling mechanism to allow the centrifuge device to rotate freely. The centrifuge device may then be reconnected, following the centrifugation, to the fluidic coupling mechanism within the test cartridge to extract the sample.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Embodiments of the present invention have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The Summary and Abstract sections may set forth one or more but not all exemplary embodiments of the present invention as contemplated by the inventor(s), and thus, are not intended to limit the present invention and the appended claims in any way.

The breadth and scope of the present invention should not be limited by any of the above-described exemplary embodiments, but should be defined only in accordance with the following claims and their equivalents.

What is claimed is:

1. A centrifuge device, comprising:

a housing having a first port and a vent opening, wherein the housing is configured to rotate about an axis passing through a center of the housing;

a chamber defined by the housing and a cover, wherein the chamber is coupled to the first port, wherein a first portion of the chamber has a width that tapers between a first width at a first position and a second width at a second position within the chamber, the first width being greater than the second width;

a channel coupled to the second position of the chamber and arranged such that a path exists for gas to travel from the channel to the vent opening; and the cover having a second port and configured to provide a wall to seal the chamber.

2. The centrifuge device of claim 1, further comprising a second chamber coupled between the channel and the vent opening.

3. The centrifuge device of claim 1, wherein the second port has a diameter between 100 and 500 micrometers.

4. The centrifuge device of claim 1, wherein the second port has a diameter between 150 and 350 micrometers.

5. The centrifuge device of claim 1, wherein the cover includes a coupling structure configured to couple the chamber with an extraction device.

6. The centrifuge device of claim 1, wherein the chamber contains a fluid volume of about 250 microliters.

7. The centrifuge device of claim 1, wherein the housing has a cylindrical shape.

8. The centrifuge device of claim 7, wherein a diameter of the cylindrical housing is less than 20 mm.

9. The centrifuge device of claim 7, wherein the first portion of the chamber extends along a circumference of the housing, and a second portion of the chamber extends radially from the axis passing through the center of the housing.

10. The centrifuge device of claim 9, wherein the second port is positioned substantially above the second portion of the chamber.

11. The centrifuge device of claim 9, wherein the second portion of the chamber has a hydraulic diameter less than 5 millimeters.

12. The centrifuge device of claim 1, wherein the housing includes a hinged portion, wherein the hinged portion is configured to swing open to expose the first port.

13. The centrifuge device of claim 12, wherein the hinged portion includes a raised structure configured to seal the first port when the hinged portion is closed.

14. The centrifuge device of claim 1, further comprising a sample indicator configured to indicate when the chamber has been filled to a maximum level.

15. The centrifuge device of claim 1, wherein a shortest distance between the channel and the axis of rotation is shorter than a distance between any point of the chamber and the axis of rotation.

16. A system comprising:

a centrifuge device, comprising:

a housing having a first port and a vent opening, wherein the housing is configured to rotate about an axis passing through a center of the housing, a chamber defined by the housing and a cover, wherein the chamber is coupled to the first port, wherein a first portion of the chamber has a width that tapers between a first width at a first position and a second width at a second position within the chamber, the first width being greater than the second width, a channel coupled to the second position of the chamber and arranged such that a path exists for gas to travel from the channel to the vent opening, and the cover having a second port and configured to provide a wall to seal the chamber;

an actuator coupled to the housing and configured to rotate the housing about the axis; and an extraction device coupled to the cover and configured to extract a sample within the chamber through the second port.

* * * * *